United States Patent [19]

Puccio et al.

[11] 4,362,429

[45] Dec. 7, 1982

[54] COVER CAP FOR THE ANCHOR BOLT RECEIVING CHANNEL OF AN EXPANSION JOINT SYSTEM RETAINER

[75] Inventors: Guy S. Puccio, Snyder; James J. Kerschner, Tonawanda, both of N.Y.

[73] Assignee: Acme Highway Products Corporation, Amherst, N.Y.

[21] Appl. No.: 155,178

[22] Filed: Jun. 2, 1980

[51] Int. Cl.[3] ..... E01C 11/04

[52] U.S. Cl. ..... 404/68; 215/320; 220/307

[58] Field of Search ..... 404/68, 69; 215/320; 220/307; 52/396, 127, 468; 14/16.5; 411/371, 373; 49/466, 464, 501, 504

[56] References Cited

U.S. PATENT DOCUMENTS

| | | | |
|---|---|---|---|
| 2,061,145 | 11/1936 | Duffy | 220/306 |
| 3,849,958 | 11/1974 | Balzer et al. | 52/396 |
| 4,067,155 | 1/1978 | Ruff et al. | 52/468 |
| 4,111,583 | 9/1978 | Brady et al. | 404/69 |
| 4,140,419 | 2/1979 | Puccio | 404/69 |

OTHER PUBLICATIONS

Watson-Bowman Associates, Inc., "Alu-Strip", Product Brochure-p. #7-5.18/Wat.

*Primary Examiner*—Nile C. Byers, Jr.

*Attorney, Agent, or Firm*—Christel, Bean & Linihan

[57] ABSTRACT

An improved retainer for an expansion joint system and a sealing cap for the anchor bolt channel thereof. The retainer channel and the cap have complementary mating profiles in the form of ledges with inclined edges and inwardly offset grooves having sloped bottom surfaces on the retainer channel walls, the cap having laterally projecting upper edge portions defining ledge receiving grooves and sloped bottom edge surfaces whereby entry of the cap into the retainer channel is facilitated by coaction between the sloped bottom surfaces of the cap and the inclined edges of the retainer ledges. The retainer ledges mate with the cap grooves to lock the cap in the retainer. The sloped bottom surfaces of the cap are supported by the sloped bottom surfaces of the retainer grooves and the laterally projecting upper edge portions of the cap are supported by the upper surfaces of the retainer ledges, the surfaces being in sealing engagement.

5 Claims, 4 Drawing Figures

Fig. 1.
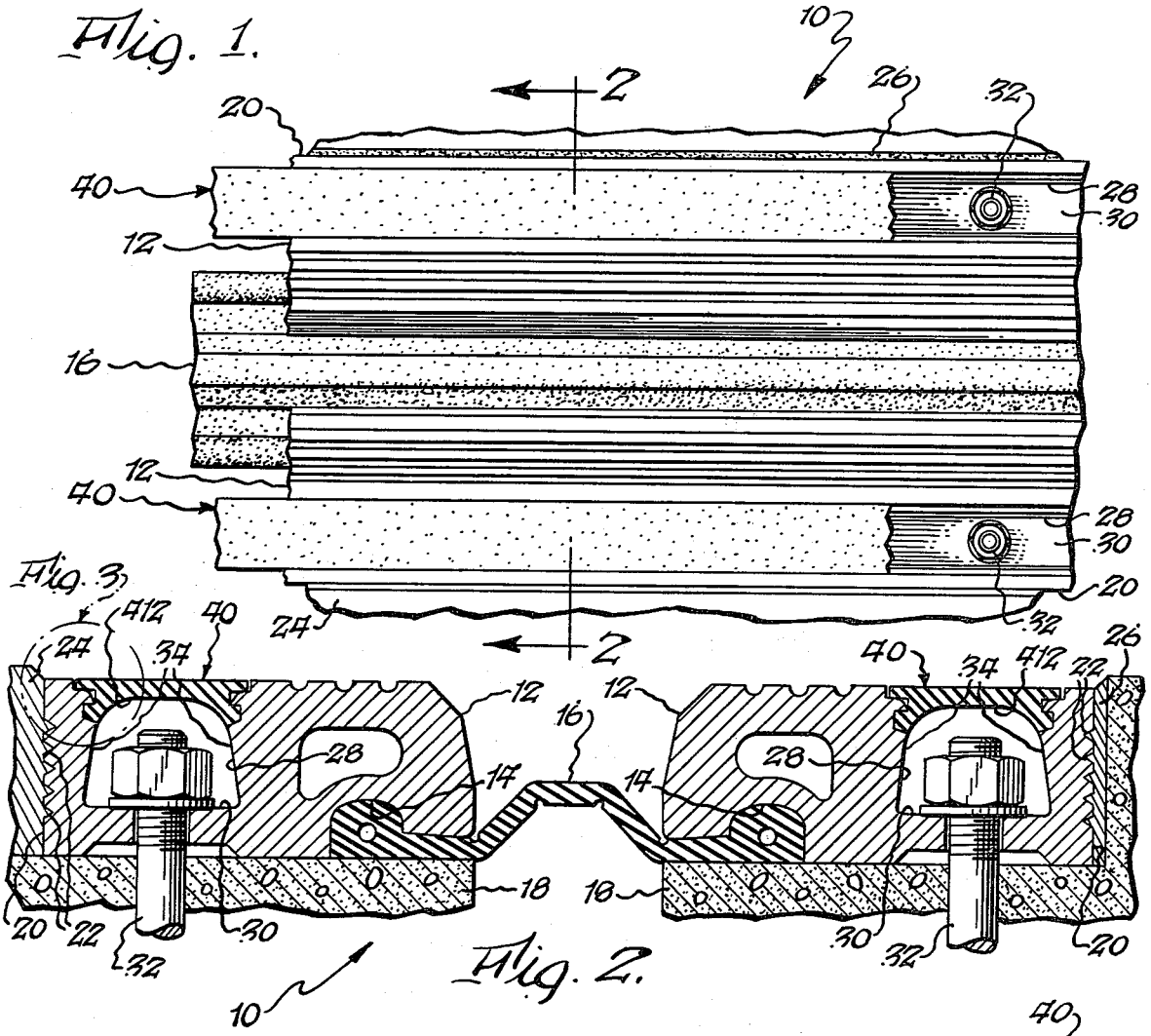
Fig. 2.
Fig. 3.
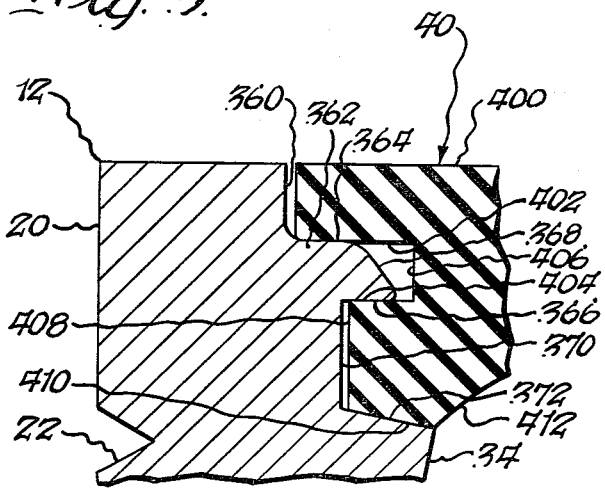
Fig. 4.
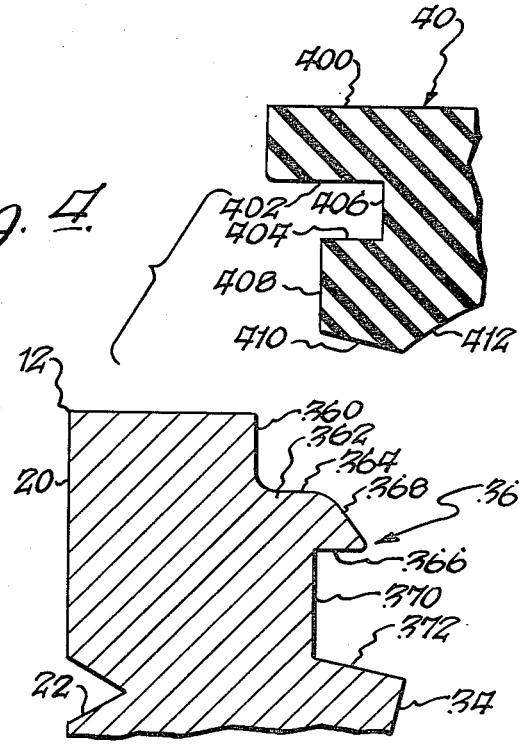

COVER CAP FOR THE ANCHOR BOLT RECEIVING CHANNEL OF AN EXPANSION JOINT SYSTEM RETAINER

BACKGROUND OF THE INVENTION

The present invention relates to expansion joint systems of the type wherein a pair of spaced retainers are secured to spaced structural slab members in a bridge deck, a roadway or the like, and a seal gland secured by the retainers bridges the gap therebetween.

The retainers of such systems typically have openings through which anchor bolts or the like pass to rigidly secure the retainers to the underlying structure. Often such openings are covered or closed to protect the interior thereof and the anchor bolts from the deteriorating effects of moisture, dirt or other foreign matter. The openings can be filled with a fluent sealing material for this purpose. Another type of closure is illustrated in U.S. Pat. No. 4,140,419 wherein a plurality of plugs are employed to seal a plurality of anchor bolt mounting apertures along the longitudinal extent of the retainer.

In another commercial construction a strip type cover is fitted into the open top of an anchor bolt channel in the retainer, the cover having laterally projecting bottom edge flanges adapted to fit into opposed grooves located in the channel walls below the upper surface of the retainer.

SUMMARY OF THE INVENTION

The primary object of this invention is to provide a strip type cover cap for an anchor bolt retainer channel so constructed and arranged as to permit rapid and easy insertion of the cover cap in the retainer channel while maintaining an effective seal therebetween, to provide adequate support for the cover cap to protect the same against buckling down into the channel under vertical and skew loads caused by vehicles or the like, and to interlock in a manner preventing pull out of the cover cap from the retainer channel as vehicles travel across the joint.

In a presently preferred form, the cover cap of the present invention has a substantially flat or planar upper surface that is substantially flush with the upper surface of the retainer when in place. A pair of grooves are disposed in opposite side faces of the cap below the upper surface and are defined by upper and lower walls with the lower walls being offset inwardly of the upper wall. The lower bottom surface of the cap is preferably sloped downwardly and inwardly at the outer edges thereof to facilitate entry of the cap into the retainer channel.

In a presently preferred form the retainer according to the present invention comprises channel walls formed to provide ledges and grooves adapted to engage and complement the grooves and bottom surfaces of the cap. Preferably, the inner peripheral surfaces of the ledges are sloped downwardly and inwardly to provide a camming surface which interacts with the bottom surfaces of the cap to facilitate the insertion thereof into the retainer channel. Moreover, the bottom surfaces of the retainer grooves each have a sloped surface that complements and mates with the sloping bottom surface of the cover cap to provide further support to the assembly.

BRIEF DESCRIPTION OF THE DRAWING FIGURES

For a fuller understanding of the present invention, reference should now be made to the following detailed description thereof, taken in conjunction with the accompanying drawing wherein:

FIG. 1 is a fragmentary top plan view of an expansion joint assembly, with parts thereof broken away to illustrate the retainer channel openings covered by sealing caps according to the present invention;

FIG. 2 is a fragmentary vertical sectional view thereof taken along line 2—2 of FIG. 1;

FIG. 3 is an enlarged detail view of a portion of FIG. 2, illustrating the sealing cap and retainer structure according to the present invention in assembled mating engagement; and FIG. 4 is a view similar to that of FIG. 3 but illustrating the sealing cap just prior to being inserted into the retainer.

DETAILED DESCRIPTION OF A PREFERRED EMBODIMENT

Referring now to the drawing and, more particularly, to FIGS. 1 and 2 the expansion joint system or assembly is generally depicted at 10 as comprising a pair of spaced, longitudinally extending retainers 12 each having a coextensive groove 14 in the bottom surface thereof and a strip seal gland 16 which spans the gap between a pair of structural slab members 18 which can be pavement sections in a bridge construction, a roadway, or the like. Retainer grooves 14 open toward the gap for receiving and mounting beaded edge formations on gland 16 in a manner similar to the system shown in U.S. Pat. No. 4,140,419. The retainers 12 may be aluminum extrusions and each have substantially planar outer side walls 20 which are interrupted by a plurality of vertically spaced, coextensive grooves 22 for improving the adhesion of gripping action between retainers 12 and an overlay material 24 such as asphalt or a non-shrink grout 26 or the like.

Intermediate the ends thereof each retainer 12 is provided with a channel 28 coextensive therewith and having a bottom 30 through which a plurality of anchor bolts 32 (only one being illustrated for each retainer) extend for securing the retainers to the slab members 18 as is well known. The side walls of each channel are tapered inwardly as shown at 34 and are formed at their upper end portions to provide a cap engaging channel structure, generally depicted at 36 in FIG. 4, forming a part of the present invention. This structure will be discussed in greater detail hereinbelow. A sealing cap, generally depicted at 40, is suitably fitted in the longitudinally extending channel structure 36 of each retainer 12, as will also be described in greater detail hereinbelow.

Referring now to FIGS. 3 and 4, it can be seen that the cap engaging channel structure 36 of each retainer 12 has a pair of opposed generally vertical side walls 360 (only one of which is illustrated in FIGS. 3 and 4, since this structure is symmetrical) coextensive with and extending downwardly from the upper, top surface thereof. Each side wall 360 terminates in a ledge 362, coextensive with retainer 12 and projecting inwardly toward the center of the channel 28, each ledge 362 having a normally generally horizontal upper surface 364 and a normally generally horizontal lower surface 366 connected by a downwardly and inwardly sloped edge surface 368. A retaining groove is formed in each channel side wall below ledge 362 and comprises the lower surface 366, a normally substantially vertical side wall surface 370 which is spaced inwardly of the channel from side wall 360, and a lower support surface 372 which projects inwardly beyond ledge 362. Support surface 372 is preferably sloped downwardly and inwardly toward tapered wall 34 for a purpose to become apparent.

The sealing cap 40 of the present invention is fabricated of a suitable resilient material such as neoprene or the like and comprises an upper planar surface 400 which in assembled form is substantially flush with the upper surface of retainer 12 and is coextensive therewith. A pair of grooves (only one of which is illustrated in FIGS. 3 and 4, since the seal is symmetrical about a vertical axis) are formed in opposite sides of cap 40, in spaced relation below upper surface 400, and are each defined by an upper, normally generally horizontal wall 402 joined to a lower normally generally horizontal wall 404 by a normally generally vertical side wall 406, the lower wall 404 being spaced inwardly and terminating short of the outer edge of the upper wall 402. The surfaces defining the grooves are coextensive with the cap 40 which is further provided on each side thereof with a normally substantially vertical side wall surface 408 extending downwardly from the lower wall 404 in inwardly offset relation to the upper side edges of cap 40. There also is provided on each side of cap 40 a bottom surface that is sloped downwardly and inwardly from side wall 408, as is depicted at 410. This bottom surface has its slope complementary to that of retainer surface 372 for a purpose to become apparent. The bottom surfaces 410 of cap 40 are joined by a concave arched undersurface 412, which adds rigidity and strength to cap 40.

It can be seen that the outer profile on each side of the cap 40 is generally complementary to the inner profile 36 on each side wall of the retainer channel for mating engagement therebetween. More specifically, the insertion of the cap 40 into the retainer channel is facilitated by the coaction between cap surfaces 410 and ledge surfaces 368 causing the former to be eased by a camming-type action into position with minimum flexure and force. Once the cap 40 is snapped into position, as shown in FIG. 3, the bottom surfaces 410 thereof are fully supported by surfaces 372 of the retainer; this being in addition to the support afforded the cap by ledge surfaces 362 in engagement with cap surfaces 402. Thus there are provided two load bearing surfaces on each side of the cap to support the same against buckling and being pushed down into the retainer channel due to outside forces applied thereto, from passing traffic or otherwise. Surfaces 372 and 410 have a relatively small slope or incline, less than 45°, thereby providing good vertical support to the cap. Ledge surface 368 have a relatively larger slope or incline, greater than 45° and in conjunction with the lesser slope of inclined surface 410 facilitate the seating of cap 40 in place. Therefore, the present invention not only provides a longitudinal seal that easily and quickly locks into place but one that has superior strength as well. At the same time, once cap 40 is seated in place ledges 362 effectively secure it against being pulled out of retainer 12 as vehicles pass over the joint.

Therefore, it is seen that this invention fully accomplishes its intended objects. Caps 40 are quickly and easily seated in place. Once seated, traffic will neither push them down into the retainer channels nor pull them out of the retainers. They effectively cover and close the anchor bolt channels, and the laterally projecting upper edge portions with their under surfaces 402, in conjunction with seating surfaces 410, seal the retainer channels against the ingress of moisture and debris.

Although a preferred embodiment of the present invention has been disclosed and described, changes thereto may obviously occur to one skilled in the art. It is, therefore, intended that the present invention be limited only by the scope of the appended claims.

What is claimed is:

1. A continuous strip type cap for sealing the anchor bolt channel of a retainer in an expansion joint system for roadways or the like, comprising:

a longitudinally extending sealing member fabricated of a resilient material, said member having a substantially planar upper surface adapted to be flush with the upper surface of the retainer when said sealing member is positioned in said channel, a longitudinal groove in each opposite side of said member coextensive therewith and spaced below said planar upper surface thereof, each of said grooves having an upper and a lower wall with the outermost edge of said lower wall thereof spaced inwardly of the outermost edge of said upper wall, a side wall coextensive with said member and extending downwardly from the outermost edge of the lower wall of each of said grooves in inwardly offset relation to the side edge portions of said upper surface, and a lower surface extending downwardly and inwardly from each of said side walls to facilitate entry thereof into said channel.

2. A strip type cap according to claim 1, in combination with a retainer of an expansion joint system, wherein said retainer comprises:

a longitudinally extending channel open at its upper end and having a pair of opposed ledges coextensive therewith below the upper surface thereof, and a retaining groove below each of said ledges coextensive therewith, the arrangement being such that when said cap is snap fitted into said channel to close and seal the open upper end thereof, said ledges enter said cap grooves to lock said cap in place, and said side walls and said lower surfaces of said cap enter said retaining grooves.

3. The combination according to claim 2, wherein each of said ledges comprise an upper surface and a lower surface connected by a downwardly and inwardly sloped end surface which coacts with said lower surface of said cap when said cap is being inserted into said channel to facilitate the installation thereof.

4. The combination according to claim 3, wherein each of said retaining grooves has a sloped lower wall corresponding to the slope of said lower surface of said cap for support and sealing engagement therewith.

5. The cap of claim 1 in combination with a retainer of an expansion joint system, wherein said retainer comprises:

a longitudinally extending channel having a pair of opposed ledges coextensive therewith below the upper surface thereof, each of said ledges comprising an upper surface and a lower surface connected by a downwardly and inwardly sloped end surface which coacts with the lower surface of said cap when said cap is being inserted into said channel to facilitate the installation thereof, a retaining groove below each of said ledges and coextensive therewith, the arrangement being such that when said cap is snap fitted into said channel to close and seal the same said ledges are engaged within said pair of grooves to secure said cap in place, said side walls and said lower surfaces of said cap being engaged within said retaining grooves.

* * * * *